US007824315B2

(12) United States Patent
Piaget et al.

(10) Patent No.: US 7,824,315 B2
(45) Date of Patent: Nov. 2, 2010

(54) STAIR CLIMBING EXERCISE APPARATUS WITH IMPROVED BELLOWS

(75) Inventors: Gary D. Piaget, 141 Deep Meadow La., East Sound, WA (US) 98245; Herbert Walter Bentz, Surry (GB)

(73) Assignee: Gary D. Piaget, East Sound, WA (US)

( * ) Notice: Subject to any disclaimer, the term of this patent is extended or adjusted under 35 U.S.C. 154(b) by 0 days.

(21) Appl. No.: 12/497,149

(22) Filed: Jul. 2, 2009

(65) Prior Publication Data

US 2009/0270230 A1 Oct. 29, 2009

Related U.S. Application Data

(63) Continuation of application No. 11/961,641, filed on Dec. 20, 2007, now Pat. No. 7,614,978.

(51) Int. Cl.
*A63B 22/04* (2006.01)
*A63B 23/10* (2006.01)

(52) U.S. Cl. ..... 482/53; 482/51; 482/80

(58) Field of Classification Search ..... 482/51, 482/52, 53, 79, 80, 111, 112, 113, 122, 123
See application file for complete search history.

(56) References Cited

U.S. PATENT DOCUMENTS 2,206,902 A 7/1940 Kost
2,829,891 A * 4/1958 Ludwig ..... 482/146
3,068,001 A * 12/1962 Portman ..... 482/91
3,598,402 A * 8/1971 Frenzl ..... 482/71
3,641,601 A * 2/1972 Sieg ..... 5/420
3,653,659 A * 4/1972 Zinkin ..... 482/49
3,821,951 A * 7/1974 Giles ..... 601/156
3,917,262 A 11/1975 Salkeld
4,195,835 A * 4/1980 Hinds et al. ..... 482/125
4,204,675 A * 5/1980 McGinnis ..... 482/80
4,279,415 A * 7/1981 Katz ..... 482/80
4,405,129 A 9/1983 Stuckey
4,635,931 A * 1/1987 Brannstam ..... 482/112
4,673,180 A 6/1987 Rice (Continued)

FOREIGN PATENT DOCUMENTS

EP 0073744 A1 3/1983

(Continued)

*Primary Examiner*—Loan Thanh
*Assistant Examiner*—Daniel F Roland
(74) *Attorney, Agent, or Firm*—Barlow, Josephs & Holmes, Ltd.

(57) ABSTRACT

An exercise apparatus includes a housing, a pair of pivoting foot treadles and a pair of reciprocating bellows that support the foot treadles. A sealed air system including a conduit interconnects the bellows and is operable for reciprocating transfer of air from bellow to bellow. Each of the foot treadles is pivotably movable between upper and lower positions, and has a resting position between the upper and lower positions. The resting position of the foot treadles defines a resting position of the bellows while the upper and lower positions of the foot treadles respectively define elongated and compressed positions of the bellows. In use, the elongated and compressed positions of the bellows are each no more than 5 degrees off the center resting position thereby reducing stress on the bellows.

12 Claims, 10 Drawing Sheets

U.S. PATENT DOCUMENTS 4,676,501 A 6/1987 Hoagland et al.
4,787,630 A 11/1988 Watson et al.
4,875,675 A 10/1989 Arad et al.
4,966,364 A * 10/1990 Eggenberger ..... 482/146
4,989,858 A 2/1991 Young et al.
5,071,116 A * 12/1991 Minear ..... 482/129
5,183,453 A * 2/1993 Yamashiro ..... 482/112
5,186,700 A * 2/1993 Wang ..... 482/111
5,230,674 A * 7/1993 Terauds ..... 482/52
5,236,407 A * 8/1993 Wang ..... 482/113
5,256,118 A * 10/1993 Chen ..... 482/53
5,267,923 A * 12/1993 Piaget et al. ..... 482/53
5,267,924 A * 12/1993 Miller et al. ..... 482/79
5,290,204 A 3/1994 Lee
5,304,105 A * 4/1994 Hsieh ..... 482/53
D348,708 S * 7/1994 Chen ..... D21/670
5,346,444 A * 9/1994 Hsieh ..... 482/53
5,441,466 A * 8/1995 Piaget et al. ..... 482/52
5,468,204 A * 11/1995 Huang ..... 482/112
5,529,562 A 6/1996 Glaser
D397,746 S * 9/1998 Drach et al. ..... D21/668
6,315,697 B1 11/2001 Chen
D456,052 S 4/2002 Steves
D461,211 S * 8/2002 Kuo ..... D21/670
D466,567 S 12/2002 Chen et al.
6,572,514 B1 * 6/2003 Calafato ..... 482/79
D481,085 S 10/2003 Ben-Moshe
6,705,975 B2 * 3/2004 Kuo ..... 482/79
6,723,026 B2 4/2004 Chen et al.
D496,700 S 9/2004 Chen
6,830,539 B2 12/2004 Chuang
D514,635 S 2/2006 Hsiao
7,112,168 B2 * 9/2006 Dalebout et al. ..... 482/146
D561,849 S * 2/2008 Piaget et al. ..... D21/670
7,364,538 B2 * 4/2008 Aucamp ..... 482/131
2003/0017916 A1 * 1/2003 Juan ..... 482/51
2003/0092538 A1 * 5/2003 Kuo ..... 482/79
2004/0048721 A1 3/2004 Chou
2004/0214691 A1 10/2004 Gottlieb-Myers et al.
2006/0073942 A1 * 4/2006 Yang ..... 482/53
2007/0202996 A1 8/2007 Lu et al.
2007/0219060 A1 9/2007 Liang
2008/0032866 A1 * 2/2008 Chang ..... 482/51

FOREIGN PATENT DOCUMENTS

EP 73744 A1 * 3/1983
GB 2031742 A * 4/1980

* cited by examiner

STAIR CLIMBING EXERCISE APPARATUS WITH IMPROVED BELLOWS

CROSS REFERENCE TO RELATED APPLICATION

This application is a continuation of non-provisional patent application Ser. No. 11/961,641 filed Dec. 20, 2007, the entire contents of which are incorporated herein by reference.

BACKGROUND OF THE INVENTION

This present invention relates to exercise machines for individual usage. More particularly, the present invention is a stair climbing exercise apparatus for comfortable, balanced, in-place exercise. In addition, the present invention is a stair climbing exercise apparatus that is durable, sturdy, and long-lasting without premature wear or blow-out of the bellows.

In-place jogging and climbing devices are known in the exercising arts, such as in U.S. Pat. No. 4,279,415, S. Katz, Jul. 21, 1981 for Exercising Device. In the Katz patent, two independent side-by-side spring-biased treadles are manipulated in a jogging, or climbing, action by coordination of the feet of the user to compress both the shock absorbing springs and surrounding plastic foam. The foam and springs, however, are limited in height and length of operation, and do not produce a consistent work load throughout a work stroke, so that realistic and comfortable foot action is afforded.

Furthermore, pivoted, slanted treadles require ankle bending and make most of the force bear upon the toes so that the body action is not ideal, particularly for a jogging motion. A variation of this device is shown in U.S. Pat. No. 4,204,675, G. McGinnis, May 27, 1980 for Air Chamber Leg Exercising Device, which uses both compressible "breathing" elastic air chamber bags and spring loaded treadles for establishing a work load, in which the exit resistance of exhausted air from the bags is controlled by a manually operable spring bias loading for an exhaust valve to establish a partly variable work load. The treadle is connected to the air bag wall to force it to suck in air from a flap valve as it is raised. Treadle hinge springs, valves and bags are critical in control and subject to overload by exerciser's weight, etc. and have limited reliability and life. Furthermore, the breathing controls take a finite time to operate in filling the bags for a power stroke, and thus limit the speeds and interfere with natural rhythm in exercising.

Bellows type air compression chambers are also disclosed in U.S. Pat. No. 4,635,931, G. Brannstam, Jan. 13, 1987 for Apparatus for Arm and Leg Exercise. This device is used by persons lying in a bed. The air in the bellows is forced in and out by exercise. Air intake and exhaust valves require the foot to be attached to the bellows, which in turn is attached to the bed, and adjustable valves resist the intake and exhaust of air to regulate the respective work loads of pushing and pulling. This operating principle is not adaptable to jogging or climbing exercise where the exercising force for each leg is provided on a downward compression stroke only.

A bladder type bag eliminates treadles in U.S. Pat. No. 4,405,129, J. Stuckey, Sep. 20, 1983 for Therapeutic Exercise Device. The bladder can be blown up to a desired pressure above atmospheric, and foot (or other body part) pressure upon two bladder compartments transfers air reciprocally from one to the other over a restricted passageway that determines in part the work load, as modified by the pressure within the bladder. This bladder construction provides a very limited work stroke length, and does not provide a sense of balance that comes with a rigid treadle platform.

One primary deficiency in the art is the inability to provide long enough stroke distances for requiring leg action and bending of the knees in jogging and climbing exercises, and stroke adjustments for adaption to various user's preferences or for simulating the distance between stair steps.

Another criticism of the prior art exercising devices is the dependency upon springs. Not only are springs costly, but they have limited life, are subject to change and stress during the course of use, are not adaptable to long or variable strokes, and afford a very limited range of work load variation.

Exercise devices should also provide an optional versatility of body building exercises. The prior art jogging-climbing devices of simple and inexpensive construction, for example, do not afford arm and shoulder exercise, as might be afforded when jogging by means of swinging weights synchronously with foot action. Further, exercising from standing, sitting and lying positions is rarely feasible in prior art devices of the class herein proposed.

The treadle operated exerciser devices of the prior art also have not been comfortable in operation to give a sense of balance when riding, walking, climbing or jogging in place on the treadles. Prior art construction of the treadles, particularly with slanted and spring biased treadle structure, tends to fatigue or over exercise ankle joints. Also, these slanted and spring biased treadle structures tend to fatigue faster when put under higher weights and forces by an operator.

In addition, long-term, repeated use of prior art constructions of bellows-type devices has shown that they tend toward premature fatigue or "blow outs" of the bellows. U.S. Pat. No. 5,267,923, as shown in prior art FIG. 1, discloses a foot treadle operated exercising apparatus for transfer of air from one foot treadle operated vertically disposed bellows to another through a restricted pathway adjustable in size by an adjustable valve to select a desired work load. One major disadvantage with the bellows as shown in the '923 patent is that the bellows tends to prematurely wear out or "blow-out" because of stretching along the outer edge of the bellows.

As shown in FIG. 2A, the bellows of the '923 patent have a central axis CA defined between the center of bottom end thereof and the center of the top end thereof. When the bellows are elongated by moving, the bellows are positioned in an elongated position (FIG. 2B) wherein the angular position of the central axis $CA^1$ of the bellows shifts forward of the resting centerline CL. During elongation (FIG. 2B), the bellows are likely to bend, become off-centered, and fail due to the significant angular movement away from the resting centerline CL. Similarly, when compressed (FIG. 2C), the bellows are positioned in a compressed position wherein the angular position of the central axis $CA^2$ of the bellows shifts rearward of the resting centerline CL. During compression, the bellows are likely to bend, become off-centered, and fail due to the significant angular movement away from the resting centerline CL (FIG. 2A). The angular displacement of the bellows from its centerline stretches the plastic material and results in premature blow-out of the bellows, especially along its outer edge where the stress is more acute.

Also, in the '923 patent, a pair of foot treadles are mounted for pivoting about pivot axis so that the housing limits the treadle stroke at the bottom of the stroke. As shown in FIG. 2B, the housing limits the treadle stroke at the top of the stroke. Similarly, as shown in FIG. 2C, the housing limits the treadle stroke at the bottom of the stroke.

In view of the foregoing, there is a desire for a stair climbing exercise apparatus with a configuration of the bellows that is not prone to blow-outs. It is also desirable to provide a stair-climbing exercise apparatus that is balanced and sturdy for extended usage by an operator. It is also desirable to have a stair-climbing exercise apparatus that has sufficient support for weights and forces to accommodate most operators. It is also desirable to have a foot treadle or treadle which allows an operator to maintain better balance during exercise.

Other objects, features and advantages of the invention will be found throughout the following description, claims and accompanying drawings.

BRIEF SUMMARY OF THE INVENTION

The present invention preserves the advantages of existing stair climbing exercise apparatus while providing new advantages not found in currently available stair climbing exercise apparatus and overcoming many disadvantages of such currently available stair climbing exercise apparatus.

The exercise apparatus comprises a housing, and a pair of foot treadles mounted in spaced parallel relation on the housing. Each of the treadles has a front end pivotably mounted to the housing and a rear end configured and arranged for receiving and supporting the foot of a user thereon. The apparatus further includes a pair of reciprocating bellows each having a bottom end and a top end with the bottom end of each of the bellows being coupled to the housing adjacent the rear ends of the foot treadles. The top end of each of the bellows is coupled to the bottom surface of the rear end of a respective one of the foot treadles. Generally, each of the bellows has a central axis extending between the bottom end and the top end thereof.

A sealed air system is positioned within the housing and includes a conduit interconnecting the bottom ends of the bellows for reciprocating transfer of air from bellow to bellow. The foot treadles are each configured and arranged for forceful actuation by force of a user's foot in a compressive direction for the air in the sealed air system to transfer air from one bellows to the other. In other words, forceful movement of one of the foot treadles in a downward compressive direction compresses the corresponding bellows and causes a reciprocal expansion of the other of the bellows and reciprocal upward movement of the other of said foot treadles.

Each of the foot treadles is pivotably movable between upper and lower positions, and has a resting position between the upper and lower positions. The resting position of the foot treadles defines a resting centerline position of the bellows, which is defined along the central axis of the bellows. The upper and lower positions of the foot treadles respectively define elongated and compressed positions of the central axis of the bellows.

The foot treadles and the bellows are specifically configured and arranged to reduce angular movement of the bellows during compression and elongation, and accordingly reduce stress on the undulations of the bellows during use. More specifically, the foot treadles and bellows are configured and arranged so that the position of the central axis of the bellows is no more than 5 degrees off the resting centerline position during reciprocal movement of foot treadles between the upper and lower positions.

To control the work effort of the user on the treadles, a manually operated valve controls the resistance or work effort for transferring the air from one bellow to the other. A stair height control is provided in the form of a manually operable air venting and admission valve. Thus, to decrease stair step heights, the air vent valve is opened and the treadles are depressed to the desired height. To increase stair step heights, the air vent becomes an air admission valve manually opened to permit the bellows to automatically extend the height to a maximum adjustment while admitting more air into the normally closed air enclosure.

Further operational features include: (1) flexible body cord for permitting simultaneous arm and leg workout by means of hand grasps on lines whereby the user can workout both the upper body and lower body at the same time; (2) at least one support positioned between the base and the cover, the support is positioned respectively below where the bellow is connected to the cover of the housing to provide support to the cover; and (3) at least one absorber attached to an upper surface of the support to reduce vibration.

Other objects, features and advantages of the invention will be found throughout the following description and in the accompanying drawings and claims.

BRIEF DESCRIPTION OF THE DRAWINGS

The novel features which are characteristic of the stair climbing exercise apparatus are set forth in the appended claims. However, the stair climbing exercise apparatus, together with further embodiments and attendant advantages, will be best understood by reference to the following detailed description taken in connection with the accompanying drawing Figures.

DETAILED DESCRIPTION OF THE PREFERRED EMBODIMENTS

Figure 1:
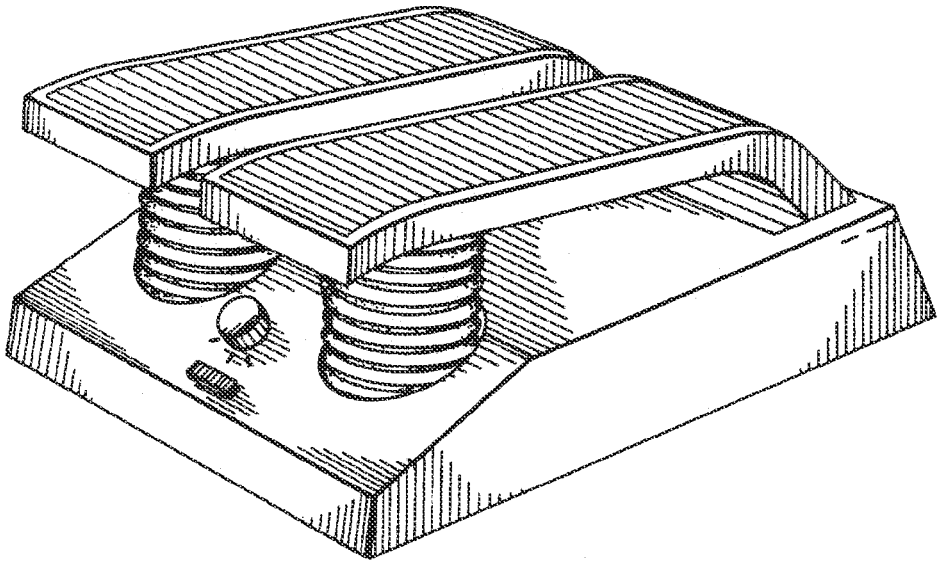
Fig. 1 Prior Art
FIG. 1 is a perspective view of a prior art device with reciprocating bellows.
Figure 2A:
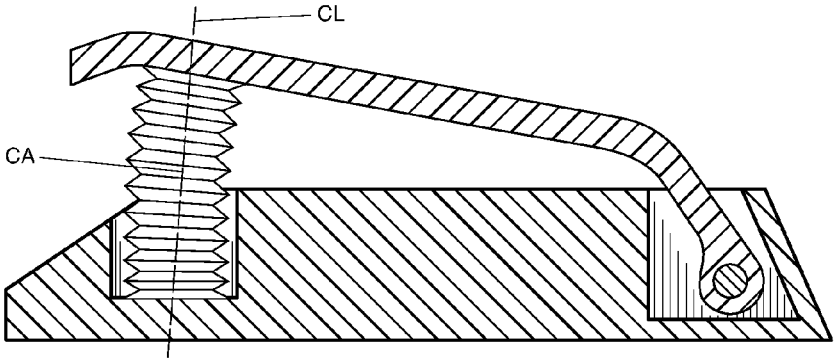
Fig. 2A Prior Art
FIG. 2A is a side view of the reciprocating bellows of FIG. 1 in the at rest position.
Figure 2B:
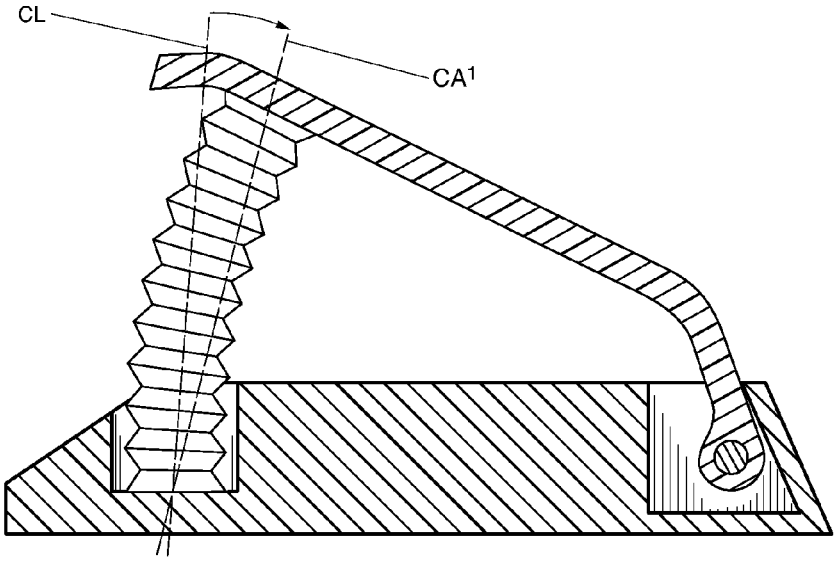
Fig. 2B Prior Art
FIG. 2B is a side view of the reciprocating bellows of FIG. 1 in the elongated position.
Figure 2C:
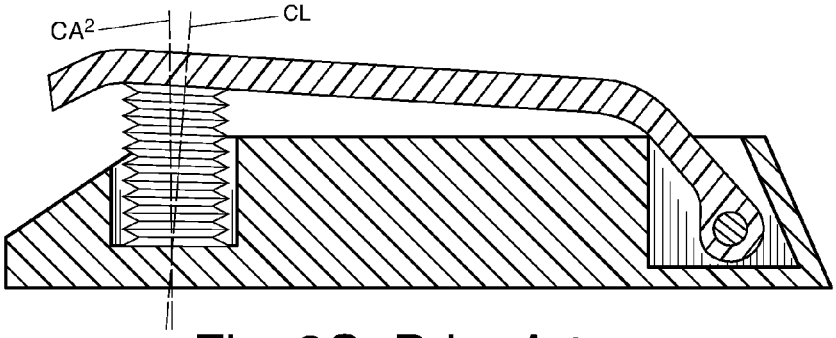
Fig. 2C Prior Art
FIG. 2C is a side view of the reciprocating bellows of FIG. 1 in the compressed position.

Referring now to the drawings, the stair climbing exercise apparatus 10 of the instant invention is illustrated in FIGS. 3-10. As will hereinafter be more fully described, the stair climbing exercise apparatus 10 includes a unique arrangement of the bellows. The unique arrangement provides bellows, which substantially decrease the likelihood of a malfunction, or "blow-out" of the bellows, especially along the undulations of its outer edge.

Figure 3:
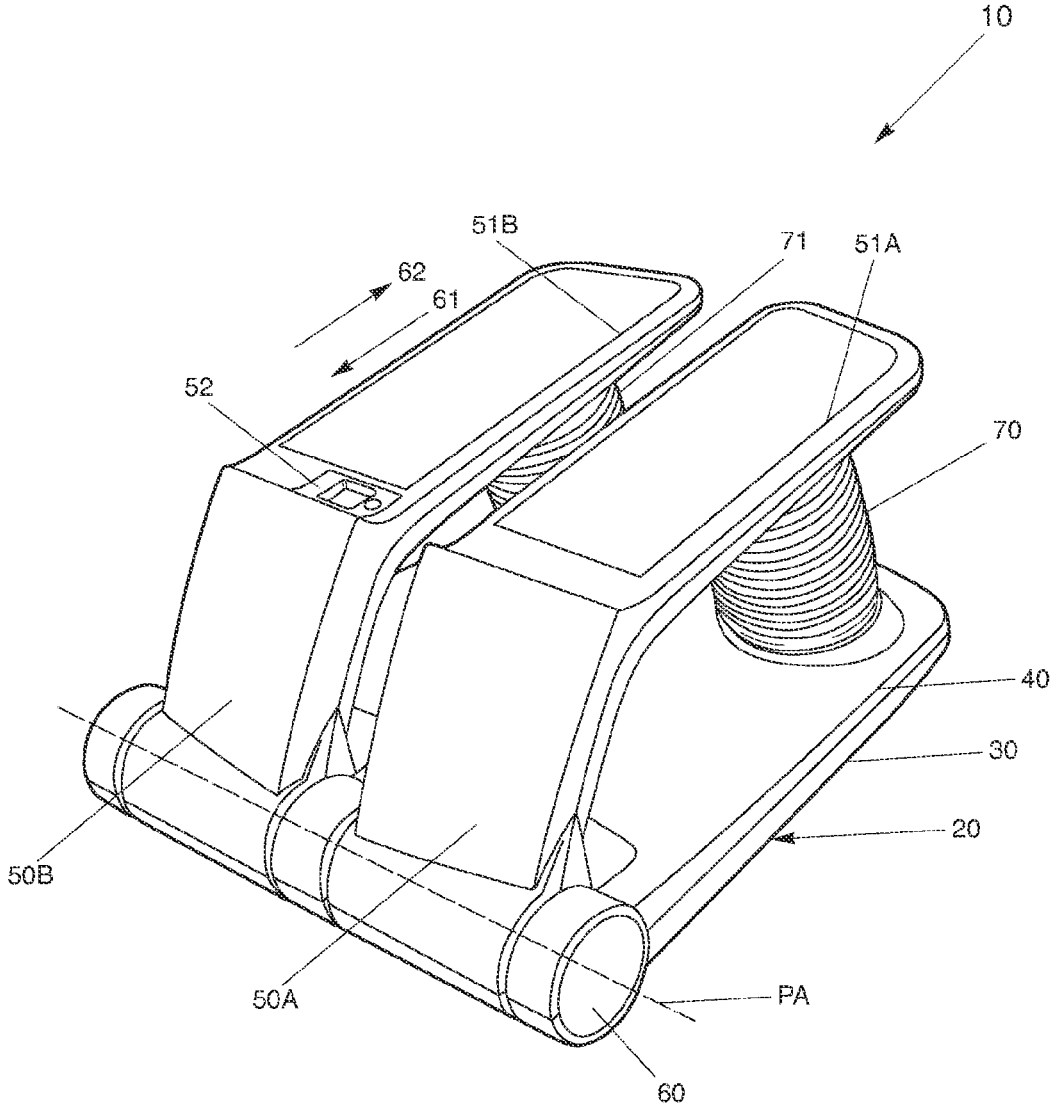
FIG. 3 is perspective view of the of the present invention.

Now referring to FIG. 3, the present invention is a stair climbing exercise apparatus 10 generally containing a housing 20 with a base 30 and a cover 40. The base is attached to the cover by a variety of fasteners. A pair of foot treadles 50A, 50B, is pivotally mounted to a pivot 60 and move relative to a pivot axis PA. In one embodiment, the pivot 60 has an elongated cylindrical shape, which is positioned between the base 30 and the cover 40. The treadles 50A, 50B respectively compress and elongate a pair of bellows 70, 71, which have a top end attached to the treadles 50A, 50B and a bottom end attached to the cover 40. The bellows 70, 71 each have a central axis CA which extends between the center of the bottom end and the center of the top end thereof. The significance of the position of the central axis CA as the treadles 50A, 50B move up and down will be explained herein below.

Figure 4A:
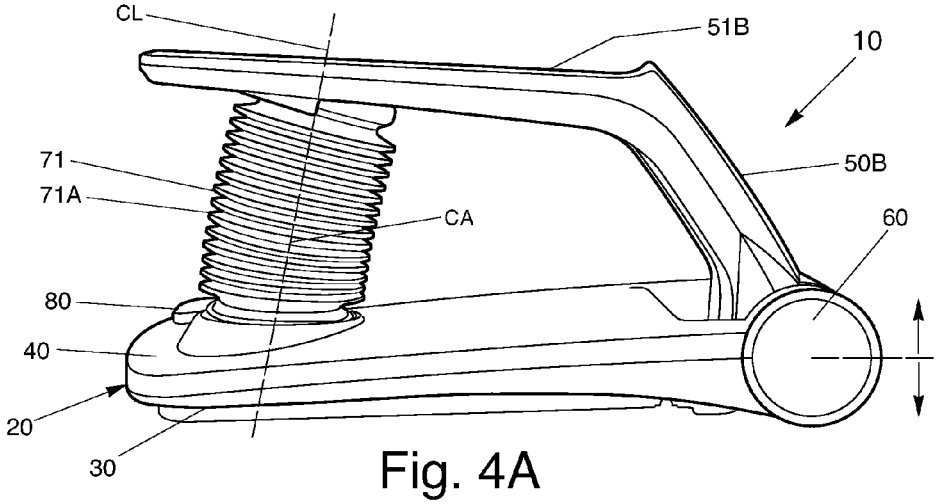
FIG. 4A is a side view of the reciprocating bellows of FIG. 3 in the at rest position.

The rear ends of the treadles 50A, 50B provide platforms 51A, 51B for engaging feet of an operator to enhance stability. The platforms 51A, 51B may contain an upper surface designed for facilitating the stability of the operator on the platforms 51A, 51B. As shown in FIG. 4A, the platforms 51A, 51B are substantially perpendicular to, the central axis CA of the bellows 70,71 so that the operator's weight on the platforms compresses and elongate the bellows 70,71 (FIG. 10) in a balanced and stable way. As indicated by arrow 61, the toes of the operator are preferably pointed towards the pivot axis PA when using the platforms 51A, 51B. This provides a lighter range of exercise. However, it may be contemplated, as indicated by arrow 62, that the toes of the operator can be pointed away from the pivot axis PA when using the platforms 51A, 51B.

It should be noted the treadles 50A, 50B are designed with a profile providing stability to the operator of the stair climbing exercise apparatus. To reduce the slant of the treadles 50A, 50B, the treadles contain an integrally formed substantially vertical portion with an integrally formed substantially horizontal portion. By reducing the slant of the treadles 50A, 50B, gravity or other forces is less likely to move the operator off the platforms 51A, 51B during operation. In one embodiment, the treadles include a digital monitor 52 for measuring workout activities such as steps by an operator over a period of time or calories burned by an operator.

Figure 4B:
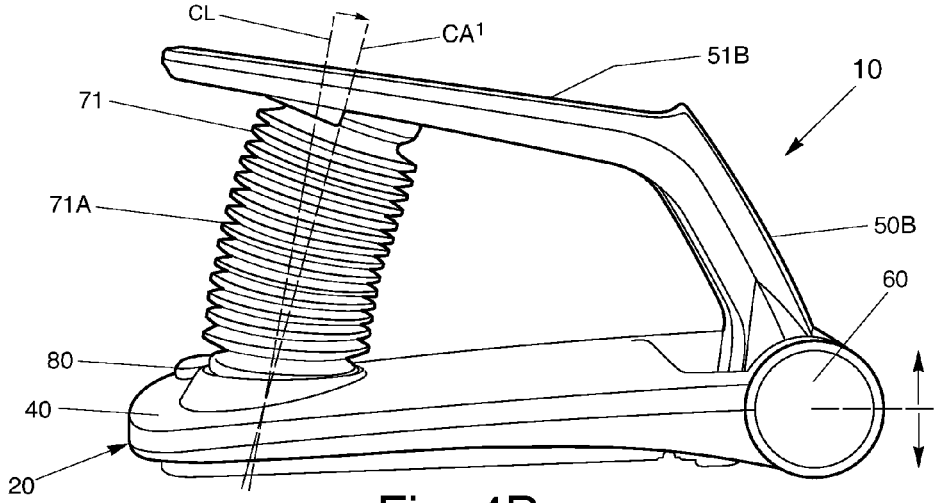
FIG. 4B is a side view of the reciprocating bellows of FIG. 3 in the elongated position.
Figure 4C:
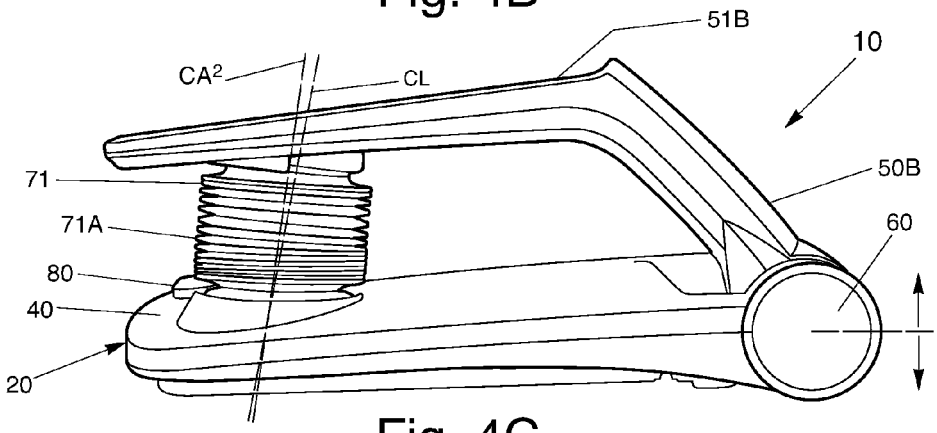
FIG. 4C is a side view of the reciprocating bellows of FIG. 3 in the compressed position.

Now referring to FIGS. 4A-4C, the treadles 50A, 50B are each pivotably movable between an upper position (See FIG. 4B) where the bellows 70, 71 are elongated and a lower position (See FIG. 4C) where the bellows 70, 71 are compressed. FIG. 4A shows the foot treadles 50A, 50B and bellows 70, 71 in an equilibrium, or at rest position. This position (FIG. 4A) defines an at rest centerline CL of the bellows 70, 71. As illustrated in FIG. 4A, in the at rest position, the central axis CA of the bellows and the at rest centerline are in alignment.

Now turning the to crux of the invention, the bellows 70,71, are configured and arranged with the housing and the treadles 50A, 50B so as to reduce stress and fatigue on the bellows 70, 71. In particular, the bellows 70,71 are configured to reduce blow-outs along an outside edge 70A, 71A, of the bellows 70,71 when the bellows 70, 71 are in the elongated position FIG. 4B. As shown in FIG. 4A, the bellows 70, 71 are in a rest position. The bellows 70, 71 have a central axis CA defined between the center of bottom end thereof and the center of the top end thereof. The angle of the central axis CA is slightly off a vertical plane relative to the platforms 51A, 51B and housing 20 when the bellows 70, 71 are at rest but is generally perpendicular to the surface of the treadle 50A, 50B. In the at rest position, the bellows 70,71 contain an equal amount of atmospheric air relative to one another.

When the bellows 70,71 are elongated by moving the attached treadles 50A, 50B away from the housing 20, the bellows 70,71 are positioned in an elongated position (FIG. 4B) wherein the angular position of the central axis $CA^1$ of the bellows shift about 5 degrees forward of the resting centerline CL. It is critical to note that when the bellows 70,71 are elongated, that the angle of the central axis $CA^1$ shift away from the resting centerline CL by no more than 5 degrees. By reducing the angular movement of the bellows 70,71 away from its resting centerline CL when in the elongated position (FIG. 4B), the undulations of the bellows 70,71 will have less bending stresses on their outside edges 70A, 71A and will thus allow prolonged use of the bellows 70,71 without premature blow-outs, especially along the outside edges 70A, 71A therof.

Similarly, when compressed (FIG. 4C) by moving the attached treadles 50A, 50B toward from the housing 20, the bellows 70,71 are positioned in an compressed position (FIG. 4C) wherein the angular position of the central axis $CA^2$ of the bellows shift about 5 degrees rearward of the resting centerline CL. Again, it is critical to note that when the bellows 70,71 are compressed, that the angle of the central axis $CA^2$ shift away from the resting centerline CL by no more than 5 degrees. During compression, the bellows 70,71 are less likely to bend, become off-centered, and fail due to the reduced angular movement away from the resting centerline CL (FIG. 4A).

Turning to a more complete description of the physical structure, the bellows 70,71 are attached to the treadles 50A, 50B at an upper end of the bellows 70,71 and to the cover 40 of the housing 20. In a preferred embodiment, an upper end of the bellows 70,71 are designed for screwing into a bottom surface of the treadles 50A, 50B. Alternatively, a first bellows insert piece, or wedge, may be added or integrally formed in the upper end of the bellows 70,71 to further decrease the angular movement of the axis of the bellows 70,71 away from the resting centerline CL.

Figure 5:
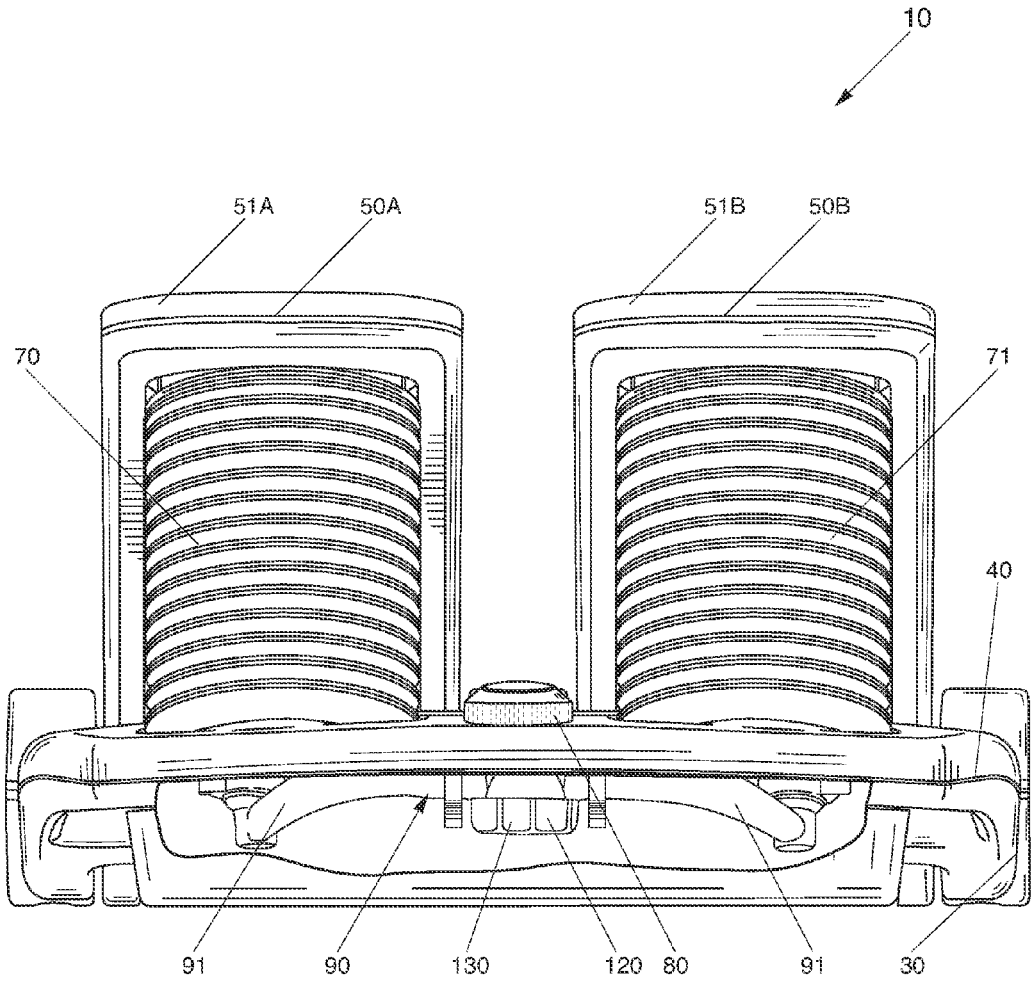
FIG. 5 is a rear view of the exercise device of the present invention of FIG. 3 with a cut away for viewing the sealed air system connecting the bellows.

Now referring to FIG. 5, a lower end of the bellows 70,71 is attached to the cover 40 of the housing 20 and to the piping 91 positioned between the cover 40 and the base 30. In one embodiment, the lower end of the bellows 70,71 has an integrally formed nozzle 73 (FIG. 6B) for insertion through the cover 30 and into fluid engagement with the piping 91. Typically, a flexible hose 91 is adapted to handle the maximum pressure expected from the compression and elongation of the bellows 70,71 with the full weight of the operator on the platforms 51A, 51B.

Still referring to FIG. 5, a sealed air system 90 is positioned within the housing 20 including a conduit for interconnecting the pair of bellows 70,71 for transfer of air. The treadle 50A, 50B moves relative to the housing 20 along the pivot axis 60 where the treadles 50A, 50B, are actuated by force of a user's foot in a compressive direction for the air in the sealed air system 90 to transfer air from one bellow 70, 71, to the other bellow 70, 71.

Figure 6A:
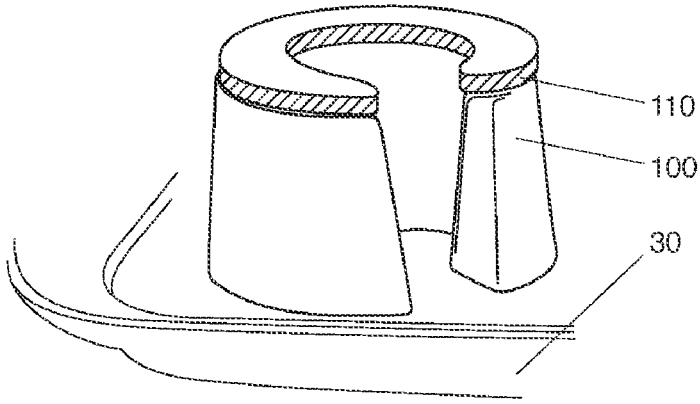
FIG. 6A is perspective view of the support integrally formed within the base of the housing of FIG. 3.
Figure 6B:
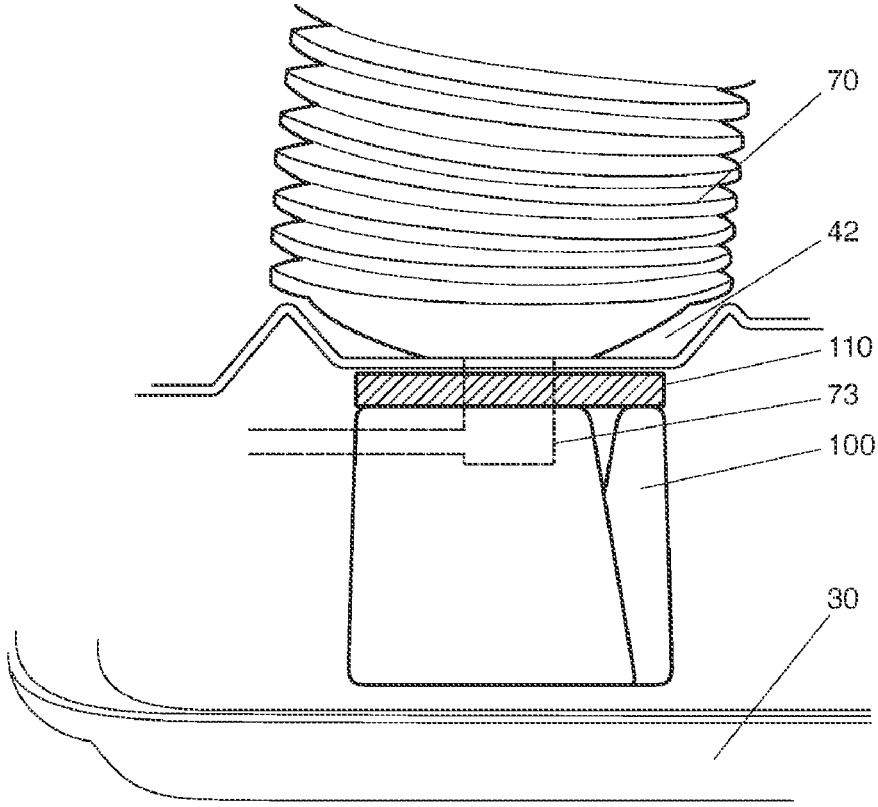
FIG. 6B is a cross-sectional view of the support respectively positioned below the bellows of FIG. 3.
Figure 7:
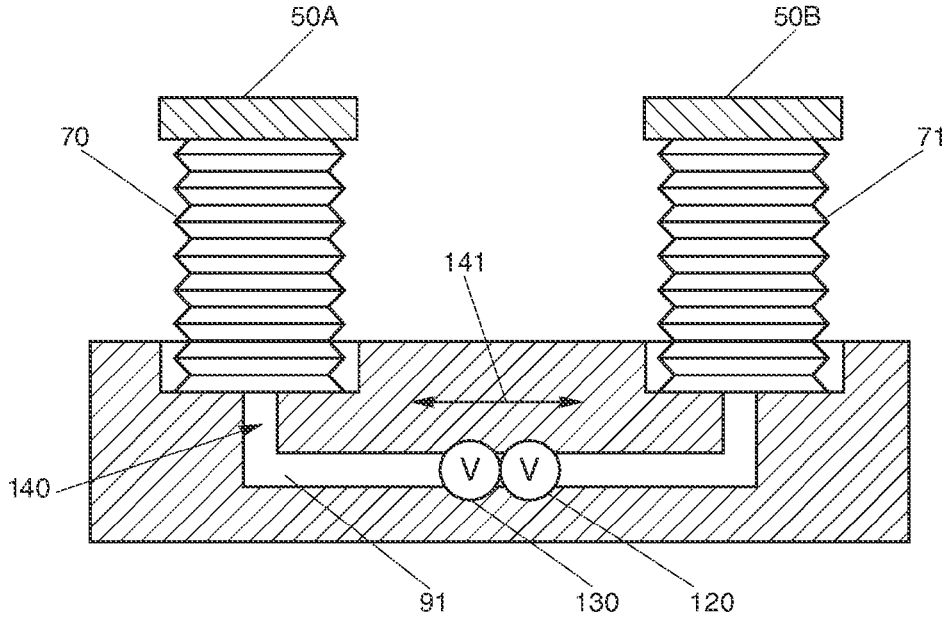
FIG. 7 is a schematic sketch of the operating system for the present invention of FIG. 3.

Referring to FIGS. 6A-6B, to provide additional stability, at least one support 100 is positioned between the base 30 and the cover 40. In a preferred embodiment, the support 100 is integrally formed within the base 30 and extends upwardly from a surface of the base 30. The support 100 is positioned respectively below where a bottom end of the bellow 70,71 is attached to a seating portion 42 within the cover 40 of the housing 20 to provide support to the cover 40 where it meets the bellows 70,71. In addition, at least one elastomoric absorber 110, as shown in FIG. 6B, is attached to an upper surface of the support 100 to reduce overall vibration of the stair climbing exercise apparatus 10.

Figure 8:
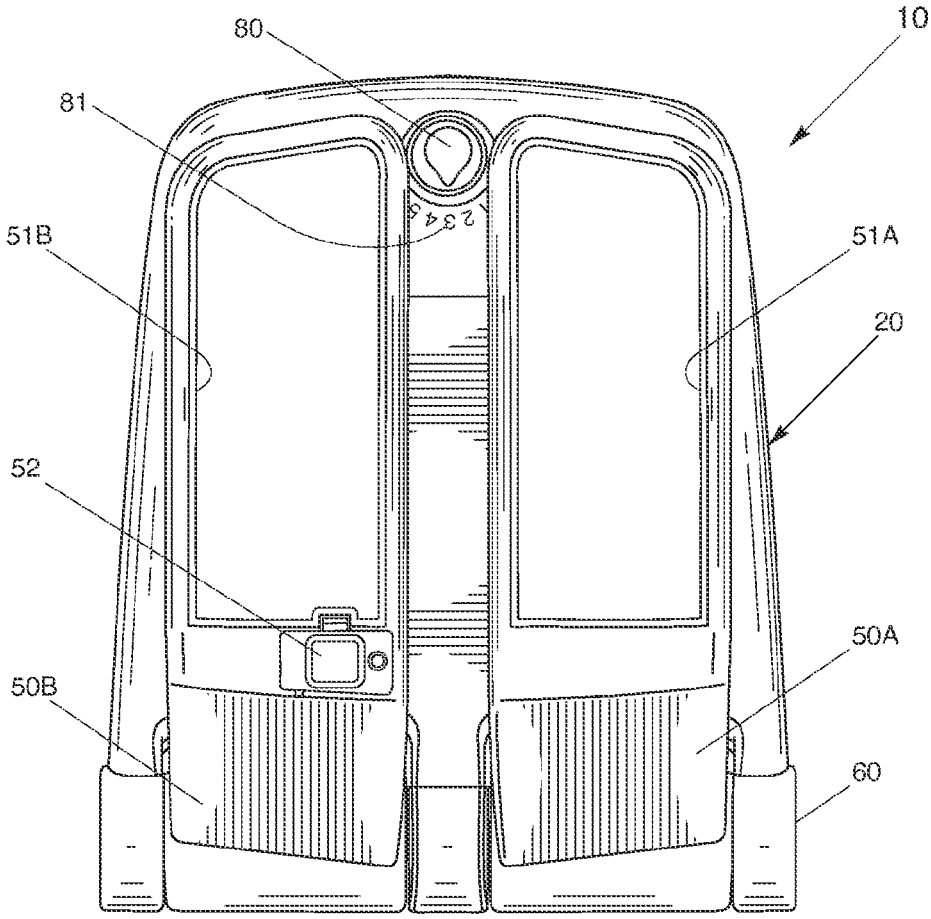
FIG. 8 is a top view of the present invention of FIG. 3.
Figure 9:
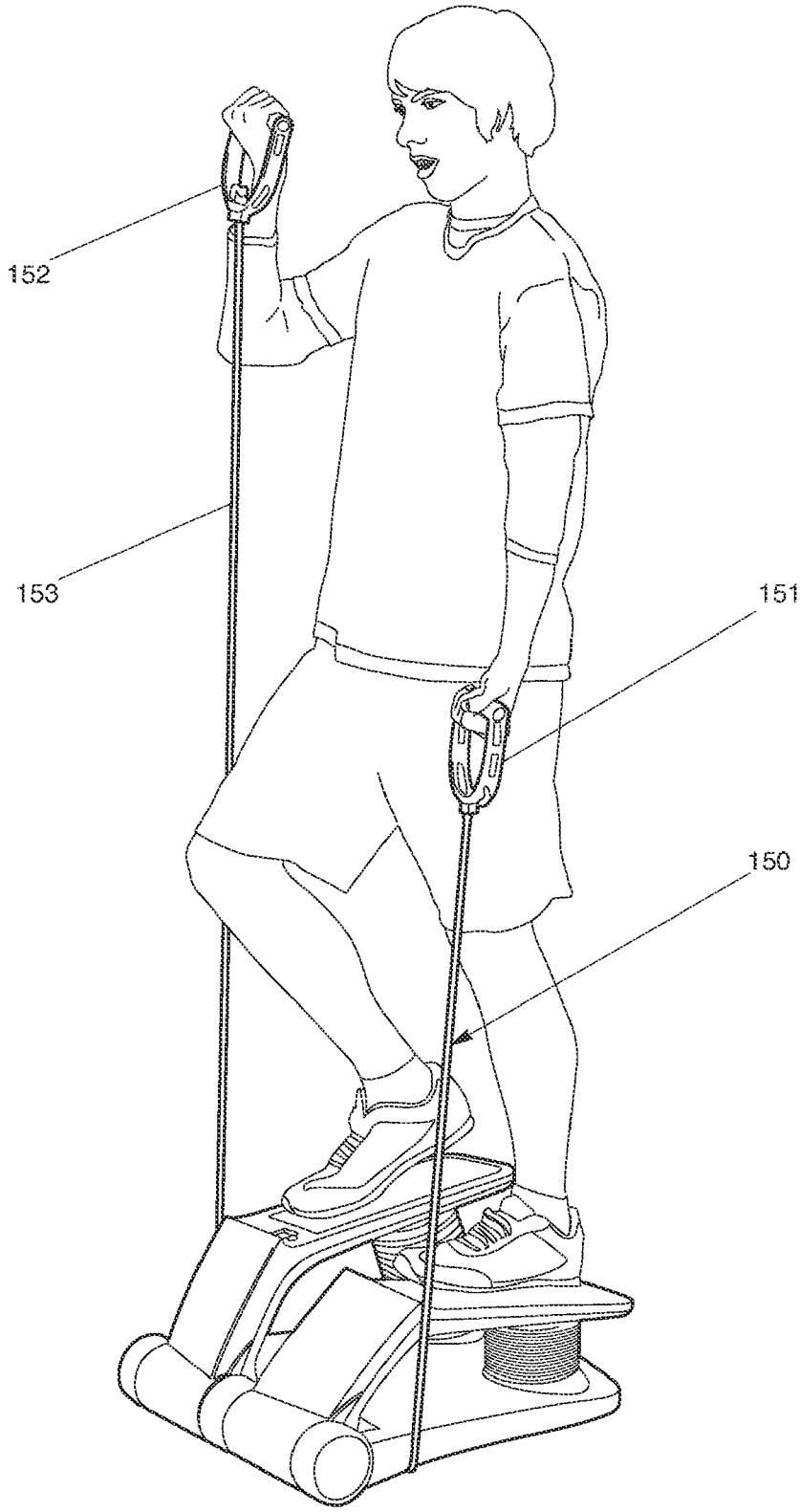
FIG. 9 is a perspective view of a user operating the present invention of FIG. 3 with a body cord.

The operation of the exercising device is clarified by the schematic working diagram of FIG. 8. The bellows 70,71 are preferably cylindrical in shape of an elastic biased plastic material such as PVC, similar to sections of flexible drain pipes. The inherent elasticity of the material is thus biased to extend rather than to retract so that the fully extended height is normally attained in the presence of atmospheric air pressure. Thus, when the (normally closed) vent valve 120 is opened the treadles 50A, 50B are pushed upwardly automatically. To adjust the stair height, therefore, one treadle 50A, 50B is forcefully depressed with vent valve 120 open to establish the desired tread height between the retracted condition of the bellows 70,71 forced downwardly with respect to the expanded position of the other bellows 70,71. Then the bellows 70,71 will reciprocate under forces imparted by the user as controlled by the restrictive flow adjustable valve 130, which is manually set for a range of exercise effort to control the reciprocal flow of air within the closed air compartment 140 as indicated by arrow 141. The vent valve 120 may also act as a safety valve to vent air upon overload of the closed air compartment 140. Thus, the height of the stair steps is inversely a function of the volume of air in the closed compartment 140.

In a preferred embodiment, the vent valve 120 and the restrictive flow adjustable valve 130 are controlled by one knob 80 attached to the cover of the housing. The knob 80 can be dialed into, in a preferred embodiment, five different restrictive flow settings, see indicia 81 in FIG. 8, to control the reciprocal flow of air within the closed air compartment 140. Also, the knob 80, when forcefully depressed, allows the vent valve 120 to increase or decrease the air inside the close air compartment 140 to establish the desired tread height of the bellows 70A, 70B. It should be noted that a separate knobs may also be used to control the vent valve 120 and the restrictive flow adjustable valve 130.

Figure 10:
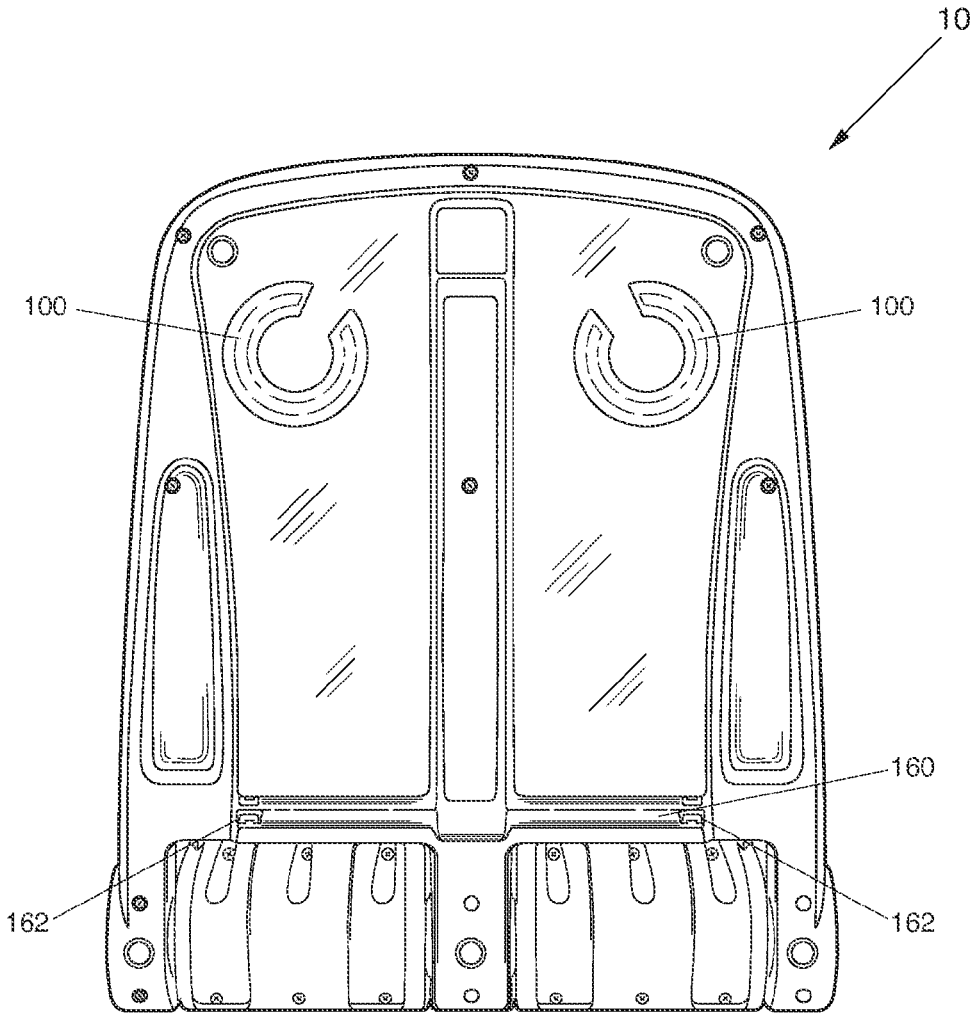
FIG. 10 is a bottom view of the present invention of FIG. 3.

Referring to FIG. 10, an embodiment for joint exercise of arms and legs is shown. A body cord arrangement 150 provides hand grips 151, 152 and a body cord 153 arranged for engagement with a cord channel 160 and tab portion 162 defined within an underside of the base 30 so that the arms can help pull the treadles downwardly. In this preferred embodiment, which provides rhythm between arm and leg movements, the body cord system 150 permits simultaneous arm and leg workouts by means of hand grips 151,152 on the body cord 153 whereby the user can workout both the upper body and lower body at the same time Based on the disclosure above, the present invention provides a stair climbing exercise apparatus 10 for comfortable, balanced, in-place exercise. In addition, the present invention is a stair climbing exercise apparatus 10 that is durable, sturdy, and long-lasting without premature wear or blow-out of the bellows 70,71.

It would be appreciated by those skilled in the art that various changes and modifications can be made to the illustrated embodiments without departing from the spirit of the embodiments. All such modifications and changes are intended to be covered by the appended claims.

What is claimed is:

1. An exercise apparatus, comprising:

a housing including a base and a cover;

a pair of foot treadles mounted in spaced parallel relation on said housing, each of said treadles having a front end pivotably mounted to said housing and a rear end configured and arranged for receiving and supporting the foot of a user thereon;

a pair of reciprocating bellows each having a bottom end and a top end, said bottom end of each of said bellows being coupled to the cover adjacent said rear ends of said foot treadles, said top end of each of said bellows being coupled to a bottom surface of a rear end of a respective one of said foot treadles, said bottom end of each of said bellows being attached to an upper surface of the cover, said bottom end of said bellows defining an integrally formed nozzle for insertion through the cover and into fluid communication with a sealed air system, each of said bellows having a central axis extending between said bottom end and said top end thereof;

a pair of bellows supports integrally formed with the base, said bellows supports respectively positioned below said bellows, said bellows supports entirely positioned underneath the cover, said sealed air system positioned between the cover and the base including a conduit interconnecting said bottom ends of said pair of bellows for reciprocating transfer of air from bellow to bellow, said foot treadles each being configured and arranged for forceful actuation by force of a user's foot in a compressive direction for the air in the sealed air system to transfer air from one bellows to the other, each of said foot treadles being pivotably movable between upper and lower positions, each of said foot treadles having a resting position between said upper and lower positions, said resting position of said foot treadles defining a resting centerline position of said central axis of said bellows, and said upper and lower positions of said foot treadles respectively defining an elongated position and a compressed position of said central axis of said bellows.

wherein said elongated position and said compressed position of said central axis of said bellows are each no more than 5 degrees off said resting centerline position during reciprocal movement of said foot treadles between said upper and lower positions thereby reducing stress on said bellows.

2. The exercise apparatus of claim 1, wherein said bellows supports generally defining a c-shape.

3. The exercise apparatus of claim 1, further comprising:

a flexible cord positioned on a bottom surface of the base, said flexible cord engages a groove defined on a bottom surface of the base, said groove includes a tab portion for retaining the flexible cord within said groove; and a pair of hand grips attached to either end of the flexible cord and being operable by the hands of a user for coordinating with a compressive force exerted by the feet of the user to provide an additional exercise movement for the user.

4. The exercise apparatus of claim 3, further comprising:

a vent configured and arranged to selectively admit and release atmospheric air to and from the sealed air system;

a flow restrictor configured and arranged to selectively restrict the passage of air from one bellow to another bellow during movement thereof; and a single control mechanism which selectively adjusts said vent and said flow restrictor, said single control mechanism including a dial with indicia.

5. The exercise apparatus of claim 4, further comprising:

a pivot positioned between the base and the cover, said foot tread treadles are pivotally mounted to the pivot for movement relative to a pivot axis.

6. The exercise apparatus of claim 1, wherein an upper surface of the cover defines a seating portion to stabilize said bottom end of said bellows.

7. The exercise apparatus of claim 6, wherein said top end of said bellows is threadably attached to said foot treadle.

8. An exercise apparatus, comprising:

a housing which includes a base and a cover;

a pair of foot treadles mounted in spaced parallel relation on said housing, each of said treadles having a front end pivotably mounted to said housing and a rear end configured and arranged for receiving and supporting the foot of a user thereon;

a pair of reciprocating bellows each having a bottom end and a top end, said bottom end of each of said bellows being coupled to the housing adjacent said rear ends of said foot treadles, said top end of each of said bellows being coupled to a bottom surface of a rear end of a respective one of said foot treadles, each of said bellows having a central axis extending between said bottom end and said top end thereof;

a sealed air system positioned within the housing including a conduit interconnecting said bottom ends of said pair of bellows for reciprocating transfer of air from bellow to bellow;

said foot treadles each being configured and arranged for forceful actuation by force of a user's foot in a compressive direction for the air in the sealed air system to transfer air from one bellows to the other;

each of said foot treadles being pivotably movable between upper and lower positions, each of said foot treadles having a resting position between said upper and lower positions;

said resting position of said foot treadles defining a resting centerline position of said central axis of said bellows;

said upper and lower positions of said foot treadles respectively defining an elongated position and a compressed position of said central axis of said bellows;

a flexible cord positioned on a bottom surface of the base, said flexible cord engages a groove defined on a bottom surface of the base, said groove includes a tab portion for retaining the flexible cord within said groove; and a pair of hand grips attached to either end of the flexible cord and being operable by the hands of a user for coordinating with a compressive force exerted by the feet of the user to provide an additional exercise movement for the user, wherein said elongated position and said compressed position of said central axis of said bellows are each no more than 5 degrees off said resting centerline position during reciprocal movement of said foot treadles between said upper and lower positions thereby reducing stress on said bellows.

9. An exercise apparatus, comprising:

a housing which includes a base and a cover;

a pair of foot treadles mounted in spaced parallel relation on said housing, each of said treadles having a front end pivotably mounted to said housing and a rear end configured and arranged for receiving and supporting the foot of a user thereon;

a pair of reciprocating bellows each having a bottom end and a top end, said bottom end of each of said bellows being coupled to the housing adjacent said rear ends of said foot treadles, said top end of each of said bellows being coupled to a bottom surface of a rear end of a respective one of said foot treadles, each of said bellows having a central axis extending between said bottom end and said top end thereof;

a pair of bellows supports integrally formed with the base, said bellows supports respectively positioned below said bellows, said bellows supports entirely positioned underneath the cover, said bellows supports generally define a c-shape;

a sealed air system positioned within the housing including a conduit interconnecting said bottom ends of said pair of bellows for reciprocating transfer of air from bellow to bellow;

a vent configured and arranged to selectively admit and release atmospheric air to and from the sealed air system;

a flow restrictor configured and arranged to selectively restrict the passage of air from one bellow to another bellow during movement thereof; a single control mechanism which selectively adjusts said vent and said flow restrictor said single control mechanism including a dial;

a pivot positioned between the base and the cover, said foot tread treadles are pivotally mounted to the pivot for movement relative to a pivot axis;

said foot treadles each being configured and arranged for forceful actuation by force of a user's foot in a compressive direction for the air in the sealed air system to transfer air from one bellows to the other, each of said foot treadles being pivotably movable between upper and lower positions, each of said foot treadles having a resting position between said upper and lower positions;

said resting position of said foot treadles defining a resting centerline position of said central axis of said bellows;

said upper and lower positions of said foot treadles respectively defining an elongated position and a compressed position of said central axis of said bellows; and wherein said elongated position and said compressed position of said central axis of said bellows are each no more than 5 degrees off said resting centerline position during reciprocal movement of said foot treadles between said upper and lower positions thereby reducing stress on said bellows.

10. An exercise apparatus, comprising:

a housing which includes a base and a cover;

a pair of foot treadles mounted in spaced parallel relation on said housing, each of said treadles having a front end pivotably mounted to said housing and a rear end configured and arranged for receiving and supporting the foot of a user thereon;

a pair of reciprocating bellows each having a bottom end and a top end, said bottom end of each of said bellows being coupled to the housing adjacent said rear ends of said foot treadles, said top end of each of said bellows being coupled to a bottom surface of a rear end of a respective one of said foot treadles, each of said bellows having a central axis extending between said bottom end and said top end thereof;

a pair of bellows supports integrally formed with the base, said bellows supports respectively positioned below said bellows, said bellows supports entirely positioned underneath the cover;

a sealed air system positioned within the housing including a conduit interconnecting said bottom ends of said pair of bellows for reciprocating transfer of air from bellow to bellow;

said bottom end of each of said bellows being attached to an upper surface of the cover, said bottom end of said bellows defining an integrally formed nozzle for insertion through the cover and into fluid communication with the sealed air system;

a vent configured and arranged to selectively admit and release atmospheric air to and from the sealed air system;

a flow restrictor configured and arranged to selectively restrict the passage of air from one bellow to another bellow during movement thereof; a single control mechanism which selectively adjusts said vent and said flow restrictor said single control mechanism including a dial;

a pivot positioned between the base and the cover, said foot tread treadles are pivotally mounted to the pivot for movement relative to a pivot axis;

said foot treadles each being configured and arranged for forceful actuation by force of a user's foot in a compressive direction for the air in the sealed air system to transfer air from one bellows to the other, each of said foot treadles being pivotably movable between upper and lower positions, each of said foot treadles having a resting position between said upper and lower positions;

said resting position of said foot treadles defining a resting centerline position of said central axis of said bellows;

said upper and lower positions of said foot treadles respectively defining an elongated position and a compressed position of said central axis of said bellows; and wherein said elongated position and said compressed position of said central axis of said bellows are each no more than 5 degrees off said resting centerline position during reciprocal movement of said foot treadles between said upper and lower positions thereby reducing stress on said bellows.

11. The exercise apparatus of claim 10 wherein an upper surface of the cover defines a seating portion to stabilize said bottom end of said bellows.

12. The exercise apparatus of claim 11, wherein said top end of said bellows is threadably attached to said foot treadle.

* * * * *